US007207558B2

(12) United States Patent
Edinger

(10) Patent No.: US 7,207,558 B2
(45) Date of Patent: Apr. 24, 2007

(54) APPARATUS FOR THE TRANSPORT OF SHEETS

(75) Inventor: Holger Edinger, Weinheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/776,361

(22) Filed: Feb. 10, 2004

(65) Prior Publication Data

US 2004/0164481 A1 Aug. 26, 2004

(30) Foreign Application Priority Data

Feb. 21, 2003 (DE) ..... 103 07 464

(51) Int. Cl.
*B65H 29/32* (2006.01)

(52) U.S. Cl. ..... 271/197; 271/276

(58) Field of Classification Search ..... 271/276, 271/196, 197; 101/419, 488; 400/579, 582; 198/811, 689.1
See application file for complete search history.

(56) References Cited

U.S. PATENT DOCUMENTS 3,889,801 A 6/1975 Boyer
4,412,738 A * 11/1983 Ahern et al. ..... 355/76
5,133,543 A * 7/1992 Eitel et al. ..... 271/276
5,139,253 A * 8/1992 Bohme et al. ..... 271/197
5,288,067 A * 2/1994 Stock ..... 271/276
5,636,833 A * 6/1997 Maier et al. ..... 271/276
5,695,043 A * 12/1997 Maezuru et al. ..... 198/689.1
5,779,236 A * 7/1998 Duncan et al. ..... 271/276
5,810,350 A * 9/1998 Pollich ..... 271/276
6,834,949 B2 * 12/2004 Greive ..... 347/104
2002/0109768 A1 * 8/2002 Greive ..... 347/104
2003/0038420 A1 * 2/2003 Cleary et al. ..... 271/197

FOREIGN PATENT DOCUMENTS

EP 0 453 790 B1 10/1991

* cited by examiner

*Primary Examiner*—Patrick Mackey
*Assistant Examiner*—Thomas A. Morrison
(74) *Attorney, Agent, or Firm*—Laurence A. Greenberg; Werner H. Sterner; Ralph E. Locher

(57) ABSTRACT

A conveying apparatus for transporting sheets to a sheet processing machine, in particular a printing press, has a suction belt table between a sheet in-feed and the sheet-processing machine. A transport belt of the suction belt table is formed with at least two rows of suction openings that exert a holding force on the sheet. Ventilation openings that reduce a frictional force of the suction belt on the feed table are provided below the transport belt in a region between the rows of suction openings.

4 Claims, 4 Drawing Sheets

APPARATUS FOR THE TRANSPORT OF SHEETS

BACKGROUND OF THE INVENTION

Field of the Invention

The invention relates to an apparatus for the transport of sheets to a sheet processing machine. In particular, the invention pertains to a sheet transport apparatus for conveying sheets to a printing press.

In order to transport sheets to a printing press, so-called belt tables are used which usually transport the sheets stashed in an imbricated stream. It has proven advantageous if the transport belts of the feed tables are provided with openings that are supplied with suction air from their underside. This ensures good retention of the sheets on the transport belt.

However, a holding force is also built up between the transport belt and feed table as a result of the prevailing vacuum. The holding force necessitates a greater transport force and additionally contributes to wear of the transport belt.

U.S. Pat. No. 5,139,253 and its corresponding European patent EP 0 453 790 B1 describe an apparatus for the transport of sheets to a printing press having a transport table and transport belts circulating on the latter. The belts are so-called suction belts. In order to lessen the wear of the suction belts and to reduce the tensile forces acting on the suction belts, there is provision for ventilation openings to be provided underneath the suction belts in a lateral region which prevent the edge of the suction belt being excessively held by suction. However, the benefits that can be achieved by the configuration of blown air ventilation openings is only small in relation to the outlay on construction.

SUMMARY OF THE INVENTION

It is accordingly an object of the invention to provide a conveying apparatus for conveying sheets to a sheet-processing machine which overcomes the above-mentioned disadvantages of the heretofore-known devices and methods of this general type and with which it is possible to minimize the holding force between the suction belt and feed table effectively.

With the foregoing and other objects in view there is provided, in accordance with the invention, an apparatus for conveying sheets to a sheet processing machine, comprising:

a feed table;

at least one suction belt disposed to be guided over the feed table and to be subjected to suction air from an underside thereof;

the suction belt having at least two mutually spaced-apart rows of suction openings formed therein; and the feed table having ventilation openings formed therein in a region between the rows of suction openings formed in the suction belt.

When relatively wide transport belts are used, it is advantageous to provide them with at least two rows of suction openings which are arranged in parallel and spaced apart from one another. As the same vacuum is built up between the rows of suction openings and the sheet to be transported as if the transport belt were provided with a larger number of suction openings in terms of area, greater stability of the transport belt can be attained as a result. A significant advantage then is the arrangement of ventilation openings between the rows of suction openings and underneath the transport belt. It is thus possible, in particular, to reduce the holding force between the suction belt and transport table in this region, while the suction air in the same region above the suction belt and the sheet is maintained to its full extent.

In accordance with an added feature of the invention, mutually parallel suction boxes are provided that communicate fluidically with the rows of suction openings for supplying suction air to the rows of suction openings. A common vacuum source communicates fluidically with the suction boxes.

In accordance with another feature of the invention, there is provided a covering plate covering the suction boxes on top. The covering plate thus becomes the feed table as well as a guide for the suction belt.

In accordance with a concomitant feature of the invention, the covering plate is formed with mutually parallel rows of suction openings and with the ventilation openings.

Other features which are considered as characteristic for the invention are set forth in the appended claims.

Although the invention is illustrated and described herein as embodied in an apparatus for the transport of sheets, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
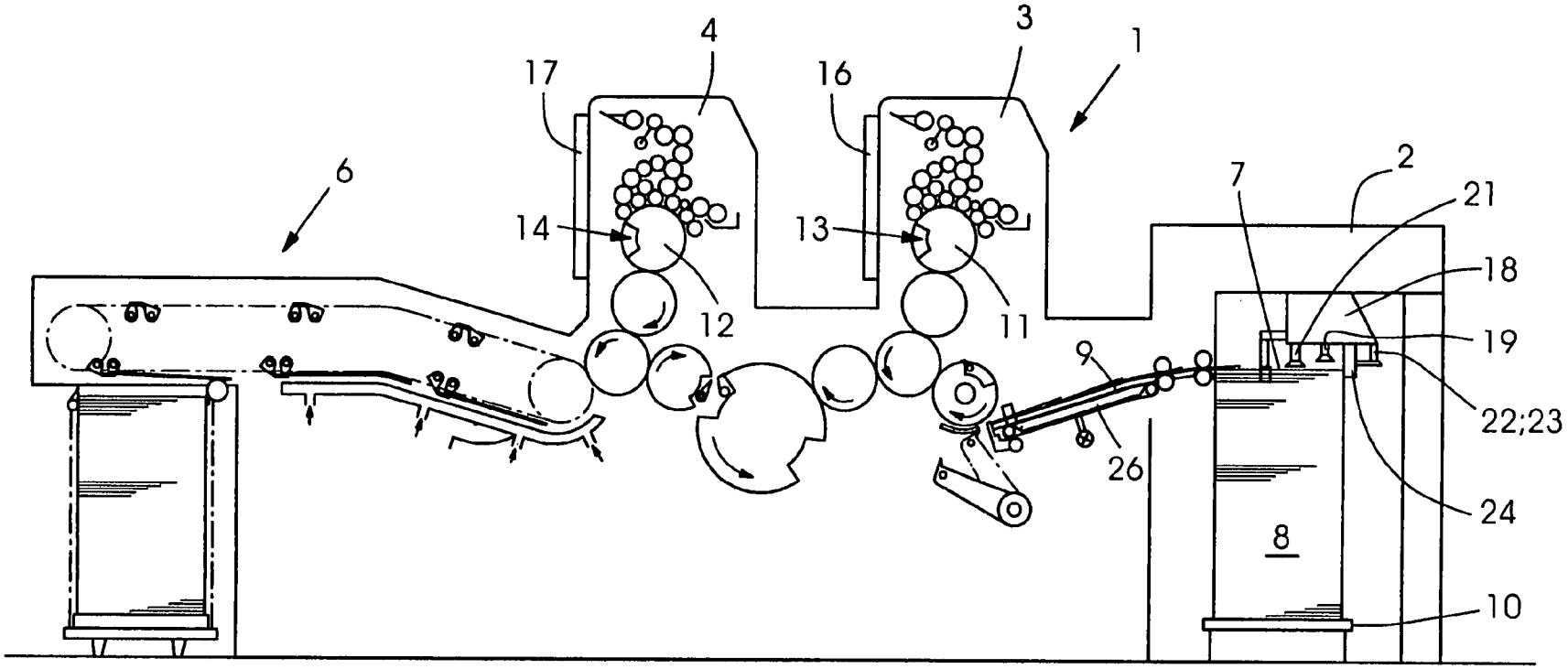
FIG. 1 is a diagrammatic side view or a longitudinal section taken through a sheet processing machine.
Figure 2:
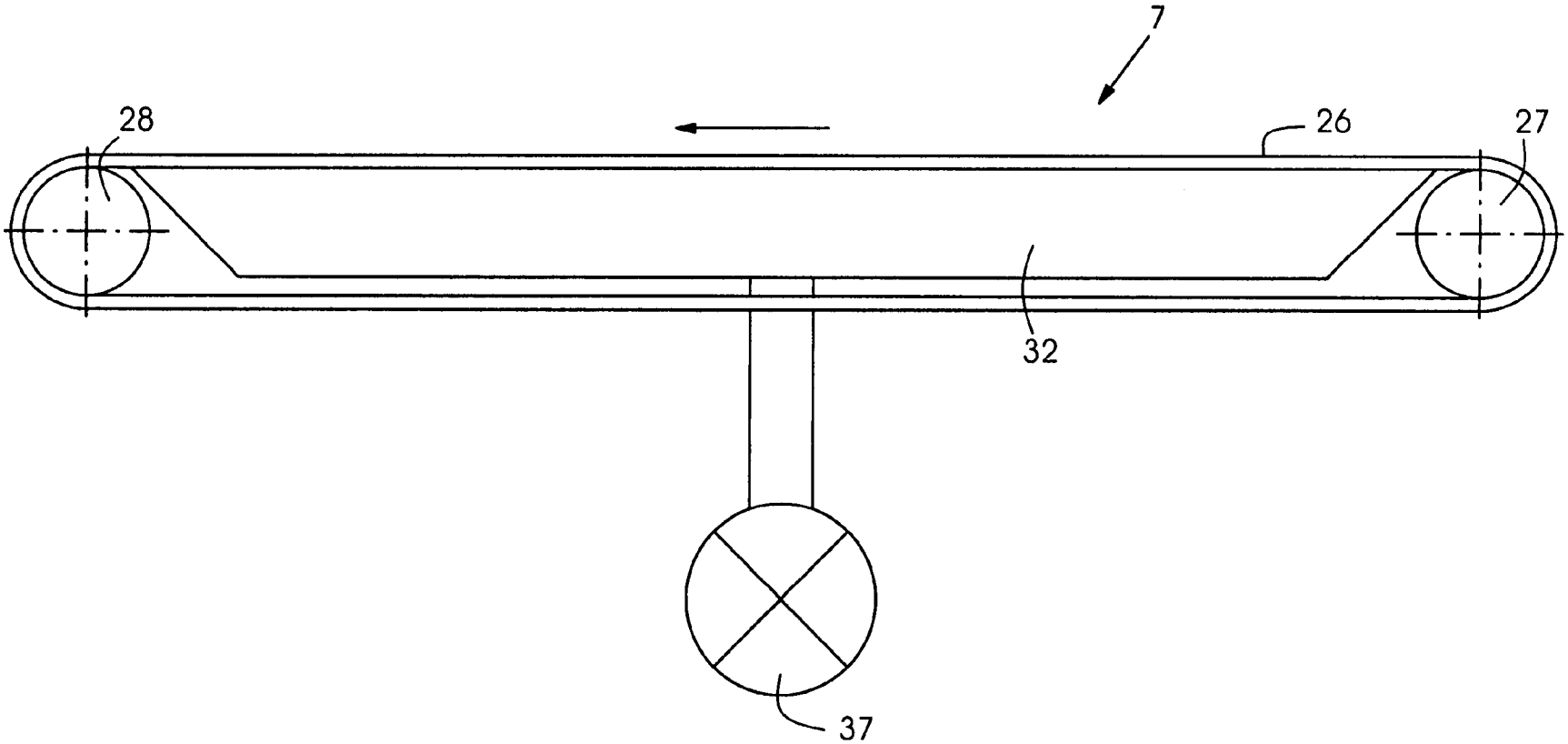
FIG. 2 is a diagrammatic sectional side view of a suction belt table according to the invention.
Figure 3:
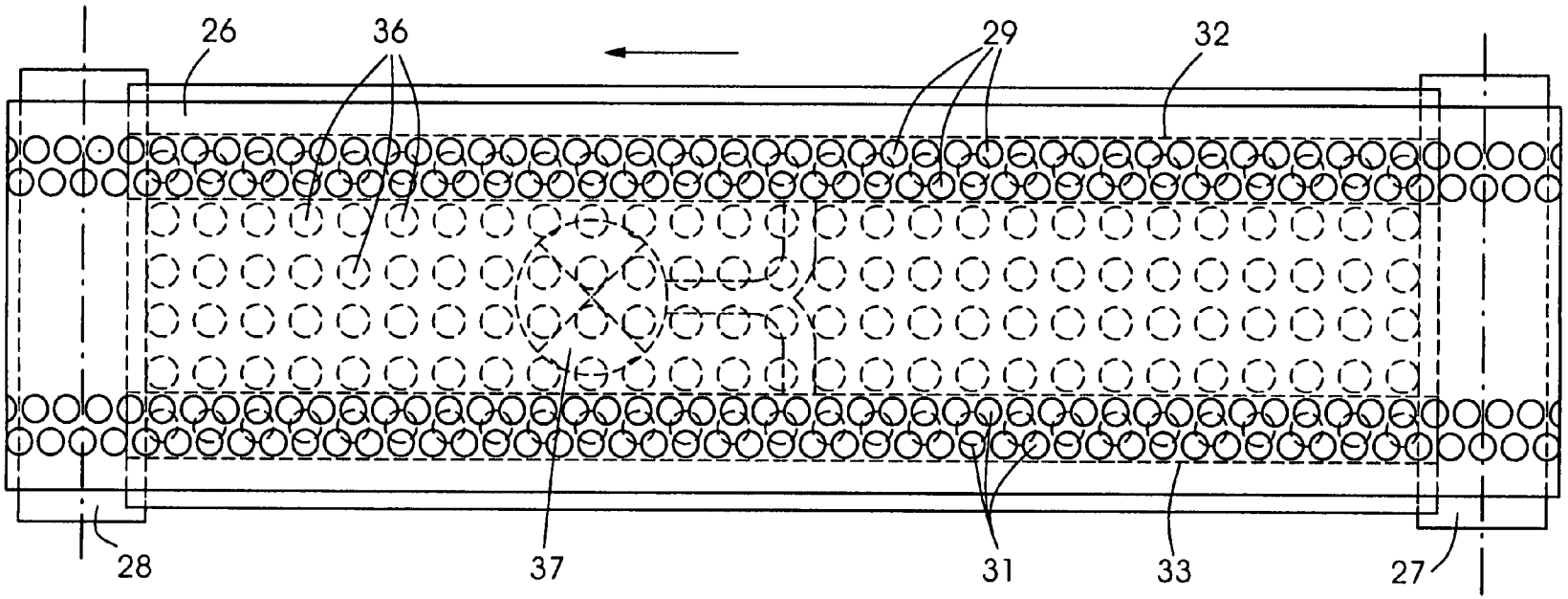
FIG. 3 is a diagrammatic plan view onto a suction belt transport table.
Figure 4:
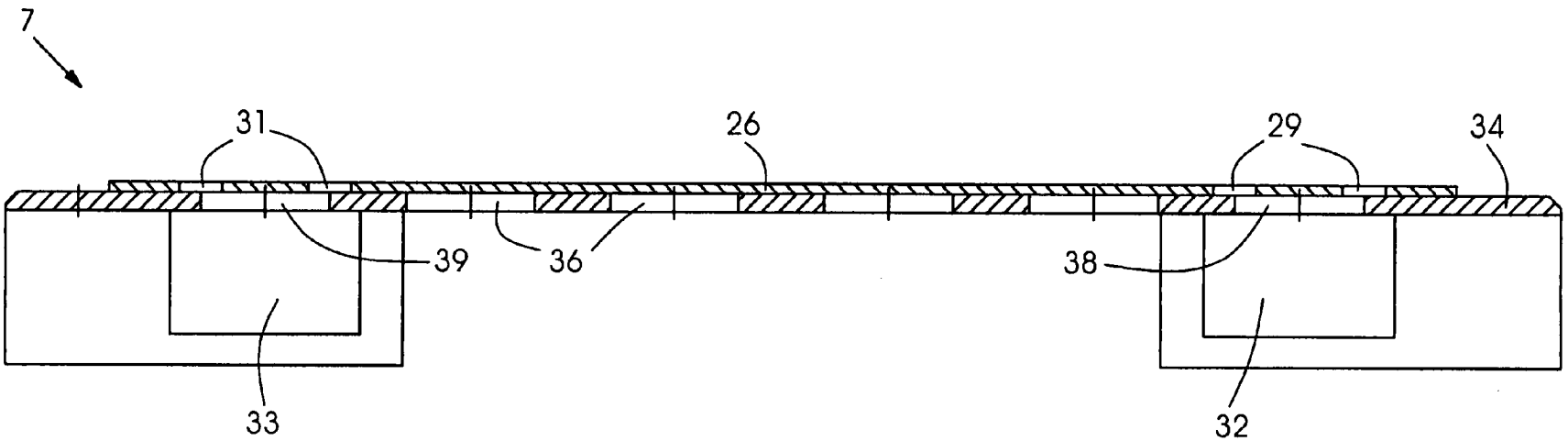
FIG. 4 is a cross sectional diagrammatic view of the suction belt transport table.

Referring now to the figures of the drawing in detail and first, particularly, to FIG. 1 thereof, there is shown a rotary printing machine that processes sheets. Here, we illustrate a printing press 1, which processes sheets 7, and which includes a feeder 2, at least one printing unit 3 or 4 and a delivery 6. The sheets 7 are taken from a sheet pile 8 and—either separated or overlapped in imbricated fashion—fed over a feed table 9 to the printing units 3 and 4. Each of the latter is a conventional unit with plate cylinder 11, 12. Each plate cylinders 11, 12 has a respective device 13, 14 for fastening flexible printing plates. Furthermore, each plate cylinder 11, 12 is assigned a device 16, 17 for semiautomatic or fully automatic printing plate change.

The sheet pile 8 rests on a pile board 10 which can be raised in a controlled manner. The sheets 7 are removed from the top of the sheet pile 8 by way of a suction head 18, as it is known. The suction head 18 includes a number of lifting and dragging suckers 19, 21 to separate the sheets 7. Furthermore, blowing devices 22 for loosening the top sheet layers and sensing elements 23 for tracking the pile are provided. In order to align the sheet pile 8, in particular the top sheets 7 of the sheet pile 8, a number of side and rear stops or lays 24 are provided.

The feed table 9 is configured with a so-called suction belt table and has at least one suction belt 26 which is guided in an endless manner around a drive roll 27 and a deflection roll 28. The endless suction belt 26 has at least two rows of suction openings 29, 31 which are spaced apart from one another. The latter are supplied with suction air by two different suction boxes 32, 33 at the same vacuum level. A covering plate is configured as a perforated plate 34, at least in the region of the suction belt 26, and covers the suction boxes 32, 33. The covering plate thus serves as a feed table 9 and as a guide for the suction belt 26. Ventilation openings 36 for the underside of the suction belt 26 are arranged in the perforated plate 34 between the rows of suction openings 29, 31. Said ventilation openings 36 are preferably connected to the surrounding air, while the rows of suction openings 29, 31 of the suction belt 26 are connected to suction openings 38, 39 in the covering plate 34.

In the exemplary embodiment, a common suction source 37 supplies the suction boxes 32, 33 with suction air. It goes without saying that it is also conceivable to provide a larger number of suction boxes one behind the other, in order for it to be possible to allow for the various requirements on the holding force, or it is also possible to provide a plurality of vacuum sources which operate, for example, at varying suction levels or else at a cyclic suction level. In every case, however, it is important that the region underneath the suction belt 26 between the rows of suction openings 29, 31 is ventilated.

If a plurality of rows of suction openings are provided per suction belt, ventilation openings for the underside of the suction belt 26 should in each case be arranged between said rows.

This application claims the priority, under 35 U.S.C. § 119, of German patent application 103 07 464.3, filed Feb. 21, 2003, which is herewith incorporated in its entirety.

I claim:

1. An apparatus for conveying sheets to a sheet processing machine, comprising:

a feed table;

at least one suction belt disposed to be guided over said feed table and to be subjected to suction air from an underside thereof;

said at least one suction belt having at least two mutually spaced-apart rows of suction openings formed therein and a continuous region, substantially without any openings, between said spaced-apart rows of suction openings; and said feed table having ventilation openings formed therein directly underneath said continuous region between said rows of suction openings, said ventilation openings extending vertically through said feed table and connecting to surrounding air.

2. The apparatus according to claim 1, which comprises mutually parallel suction boxes connected to said feed table, said suction boxes communicating with said rows of auction openings for supplying suction air to said rows of suction openings, and a common vacuum source communicating with said suction boxes.

3. The apparatus according to claim 2, wherein said feed table includes a covering plate covering said suction boxes on top, said covering plate forming a guide for said suction belt.

4. The apparatus according to claim 3, wherein said covering plate is formed with said ventilation openings.

* * * * *